US008118247B2

(12) United States Patent
Lang et al.

(10) Patent No.: US 8,118,247 B2
(45) Date of Patent: Feb. 21, 2012

(54) AGITATOR BALL MILL

(75) Inventors: Frank Ronald Lang, Muttenz (CH); Marc Weider, Blotzheim (FR); Erich Jeker, Buesserach (CH)

(73) Assignee: Willy A. Bachofen AG, Muttenz (CH)

( * ) Notice: Subject to any disclaimer, the term of this patent is extended or adjusted under 35 U.S.C. 154(b) by 0 days.

(21) Appl. No.: 12/828,173

(22) Filed: Jun. 30, 2010

(65) Prior Publication Data

US 2011/0000993 A1 Jan. 6, 2011

(30) Foreign Application Priority Data

Jul. 6, 2009 (EP) ..... 09164693

(51) Int. Cl.
*B02C 17/16* (2006.01)

(52) U.S. Cl. ..... 241/171; 241/57; 241/172

(58) Field of Classification Search ..... 241/171, 241/172, 57

See application file for complete search history.

(56) References Cited

U.S. PATENT DOCUMENTS

| | | | | |
|---|---|---|---|---|
| 3,350,280 | A * | 10/1967 | West | 202/99 |
| 3,682,399 | A | 8/1972 | Kaspar et al. | |
| 3,762,657 | A | 10/1973 | Schieritz | |
| 4,382,557 | A | 5/1983 | Duerr | |
| 5,312,055 | A * | 5/1994 | Barthelmess et al. | 241/172 |
| 5,464,163 | A * | 11/1995 | Zoz | 241/172 |
| 5,630,558 | A * | 5/1997 | Nitta et al. | 241/172 |

FOREIGN PATENT DOCUMENTS

| | | |
|---|---|---|
| CN | 1528711 | 9/2004 |
| DE | 2215790 | 3/1972 |
| EP | 0627262 A1 | 5/1994 |
| EP | 0771591 A | 5/1997 |
| EP | 1468739 A1 | 3/2004 |
| WO | WO 03/004168 A | 1/2003 |

* cited by examiner

*Primary Examiner* — Mark Rosenbaum
(74) *Attorney, Agent, or Firm* — Wolf, Greenfield & Sacks, P.C.

(57) ABSTRACT

An agitator ball mill for finely grinding or dispersing material has a cylindrical or conical grinding chamber for accommodating grinding bodies and for accommodating the material which is to be ground or dispersed. It also has an inlet, which is arranged at one end of the grinding chamber, an agitator, which extends in the axial direction into the grinding chamber and has agitating means, and a product outlet for the ground or dispersed material, the product outlet being arranged at the other end of the grinding chamber. Arranged in a central region at the outlet end of the grinding chamber is a gas outlet through which gaseous components, but not grinding bodies, can be discharged out of the grinding chamber.

9 Claims, 5 Drawing Sheets

AGITATOR BALL MILL

Figure 1:
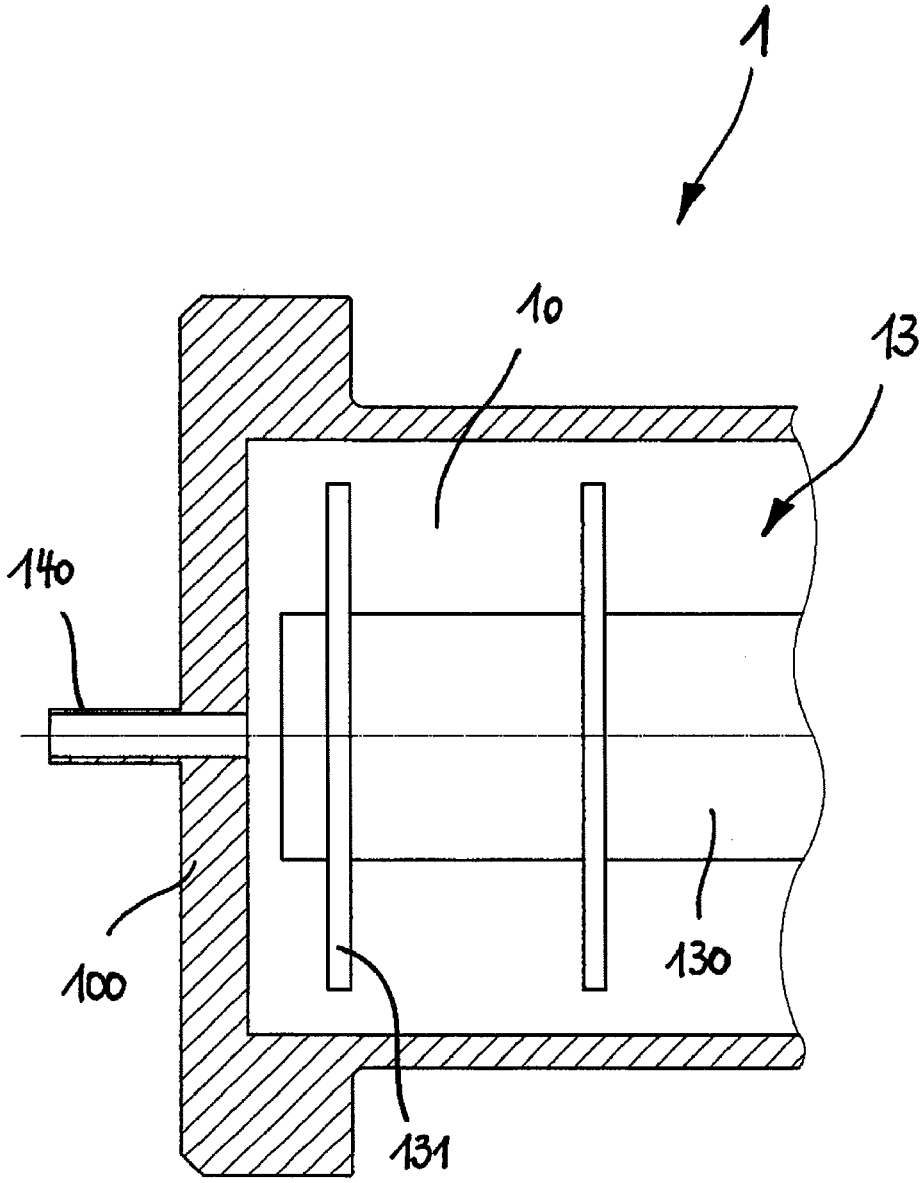

The invention relates to an agitator ball mill according to the independent claim.

Agitator ball mills are used, for example, for comminuting or dispersing solids in a liquid phase, in particular for nanotechnology products, but also, for example, for dye suspensions, paints, inks, agrochemicals, filler suspensions, cosmetics, foods, pharmaceuticals or microorganisms.

The material which is to be ground, or dispersed in a liquid, is introduced into the grinding chamber through the inlet which is arranged at one end of the grinding chamber, and is ground or dispersed in this grinding chamber. The material here is moved gradually through the grinding chamber, whereupon the ground or dispersed material can be discharged out through a separating means, e.g. through a dynamic separating gap or through a slotted screen, and then through an outlet, which is arranged at the end located opposite the inlet. When the agitator ball mills are in operation, the basic distinction is drawn between batch operation and circulating operation.

During batch operation, the material which is to be ground or dispersed is pumped from a first vessel, through the agitator ball mill, into a second vessel. In order to achieve a desired degree of fineness of the ground or dispersed product, it is possible for the product, if appropriate, to be pumped once again from the second vessel, through the agitator ball mill, into a further vessel, and so on (multi-pass batch operation).

During circulating operation, the material which is to be ground or dispersed is pumped out of a vessel into the agitator ball mill and back again into the same vessel, until the desired degree of fineness of the ground or dispersed product has been achieved. The basic functioning of such agitator ball mills is known and described, for example, in EP 0 627 262 or DE 2 215 790.

Agitator ball mills make use of various separating techniques in order to separate the ground or dispersed product from the grinding bodies. Examples of these techniques are dynamic separating gaps, which comprise a rotor and a stator, and screens, e.g. slotted screens. On account of the greater through-passage surface area, it is generally possible to realize a higher throughput by using screens. However, the through-passage through the slots of the slotted screens can be obstructed, inter alia, by gas bubbles if the material which is to be ground is not degassed prior to entrance into the grinding chamber. Moreover, the space which contains the gas bubbles is not available for grinding or dispersing, and gas bubbles can result in crust formation and in the sticking together of the grinding bodies and/or the material which is to be ground or dispersed. This results in a reduction in the grinding capacity and, in extreme cases, may lead to the agitator ball mill being blocked. When gas bubbles occur in the material, the bubbles are comminuted further by turbulence and grinding bodies, which may also result in foaming and thus in the screen being blocked to an even more pronounced extent. The pressure in the grinding chamber here can increase quite considerably and become so high that, in extreme cases, operation of the agitator ball mill has to be interrupted.

It is therefore an object of the invention to improve an agitator ball mill of the type mentioned to the extent where the aforementioned problems no longer occur or, at least, are vastly reduced.

This object is achieved according to the invention by an agitator ball mill as is characterized by the features of the independent claim. Advantageous exemplary embodiments of the agitator ball mill according to the invention form the subject matter of the dependent claims.

In particular the agitator ball mill according to the invention for finely grinding or dispersing a material has a cylindrical or conical grinding chamber for accommodating grinding bodies and for accommodating the material which is to be ground or dispersed. It also has an inlet for the material which is to be ground or dispersed, the inlet being arranged at one end of the grinding chamber, and an agitator, which extends in the axial direction into the grinding chamber and has agitating means by way of which the grinding bodies and the material which is to be ground or dispersed are moved in the grinding chamber. Finally, it has a product outlet for the ground or dispersed material, the outlet being arranged at the other end of the grinding chamber. Arranged in a central region at the outlet end of the grinding chamber is a gas outlet through which gaseous components, but not grinding bodies, can be discharged out.

The present invention is thus an venting system for removing gaseous components from the grinding chamber. The centrifugal force which is generated by the agitator, by way of its agitating means, is utilized here in order to separate the gaseous components, in particular gas bubbles, from a solids suspension. In the centrifugal force field, the solids suspension and the grinding bodies are centrifuged outwards on account of their higher density (in comparison with the gas bubbles), while the gas bubbles, e.g. air bubbles, remain in the central region (approximately in the centre). This separation takes place basically irrespective of the type and form of the agitating means of the agitator. It is thus possible for "gas to be vented" from the grinding chamber through the gas outlet arranged centrally at the outlet end of the grinding chamber. Depending on the configuration of this gas outlet, it is preferably possible for the gas outlet to be provided with a screen, in order to prevent grinding bodies from flowing out.

The venting of gas can be achieved in various ways in design terms. While it is basically sufficient to have an venting bore, the gas outlet comprises, in the case of an exemplary embodiment of the agitator ball mill according to the invention, a gas-outlet channel extending in the axial direction.

A number of variants are conceivable here. Thus, in the case of an exemplary embodiment of the agitator ball mill according to the invention, the agitator has a shaft, on which the agitating means are fixed, and the axially extending gas-outlet channel runs through the shaft.

In the case of a further exemplary embodiment of the agitator ball mill according to the invention, the axially extending gas-outlet channel extends through a terminating wall which is arranged at the outlet end and bounds the cylindrical or conical grinding chamber. This variant is straightforward in design terms and makes a number of further variants possible, as will be explained hereinbelow.

Thus, in the case of a further exemplary embodiment of the agitator ball mill according to the invention, the product outlet for the ground or dispersed material is likewise arranged in the central region of the outlet-end terminating wall, and comprises a product-outlet channel extending in the axial direction through the outlet-end terminating wall. It is possible here for the product-outlet channel and the gas-outlet channel to be designed as outlet channels which are separate from one another. As an alternative, the exit of the gas-outlet channel can open out into the product-outlet channel upstream of the exit of the product-outlet channel. This makes it possible to achieve a kind of Venturi effect, in that the air can be entrained by the outflowing product.

In the case of a further exemplary embodiment of the agitator ball mill according to the invention, a separating means (e.g. a slotted screen) which is permeable to the ground or dispersed material, but not to the grinding bodies, is arranged upstream of the product outlet, or upstream of the product-outlet channel, such that the ground or dispersed material can pass only essentially radially through the separating means and then into the product outlet or the product-outlet channel. The ground or dispersed product, which has been displaced radially outwards by the centrifugal force, can thus flow back radially through the separating means in the direction of the product outlet, which is arranged centrally in the outlet-end terminating wall. The grinding bodies here are restrained by the separating means, while the ground or dispersed product with the desired specifications (particle size) can flow through the separating means (e.g. the slotted screen) in the direction of the product outlet. The separating means here may be designed as a cylindrical screen cartridge, the gas-outlet channel running in the axial direction through the centre of the interior of the screen cartridge. The cylindrical screen cartridge can easily be exchanged or cleaned, should this be necessary.

As already mentioned in the introduction, it is possible, in the case of an exemplary embodiment of the agitator ball mill, for a screen to be arranged at the entrance to the gas outlet or the gas-outlet channel, and this screen is designed such that it restrains at least the grinding bodies in the grinding chamber.

In order to enhance the venting of gas, the exit of the gas outlet or of the gas-outlet channel may be connected to a vacuum vessel. The product taken in by the vacuum can be separated off and be returned separately to the inlet of the agitator ball mill.

As already mentioned, the type and form of agitating means on the shaft of the agitator can be selected optimally depending on the purpose for which they are required. In particular, the agitator may have a shaft which has paddle wheels, discs or pins fixed thereon as agitating means.

Figure 2:
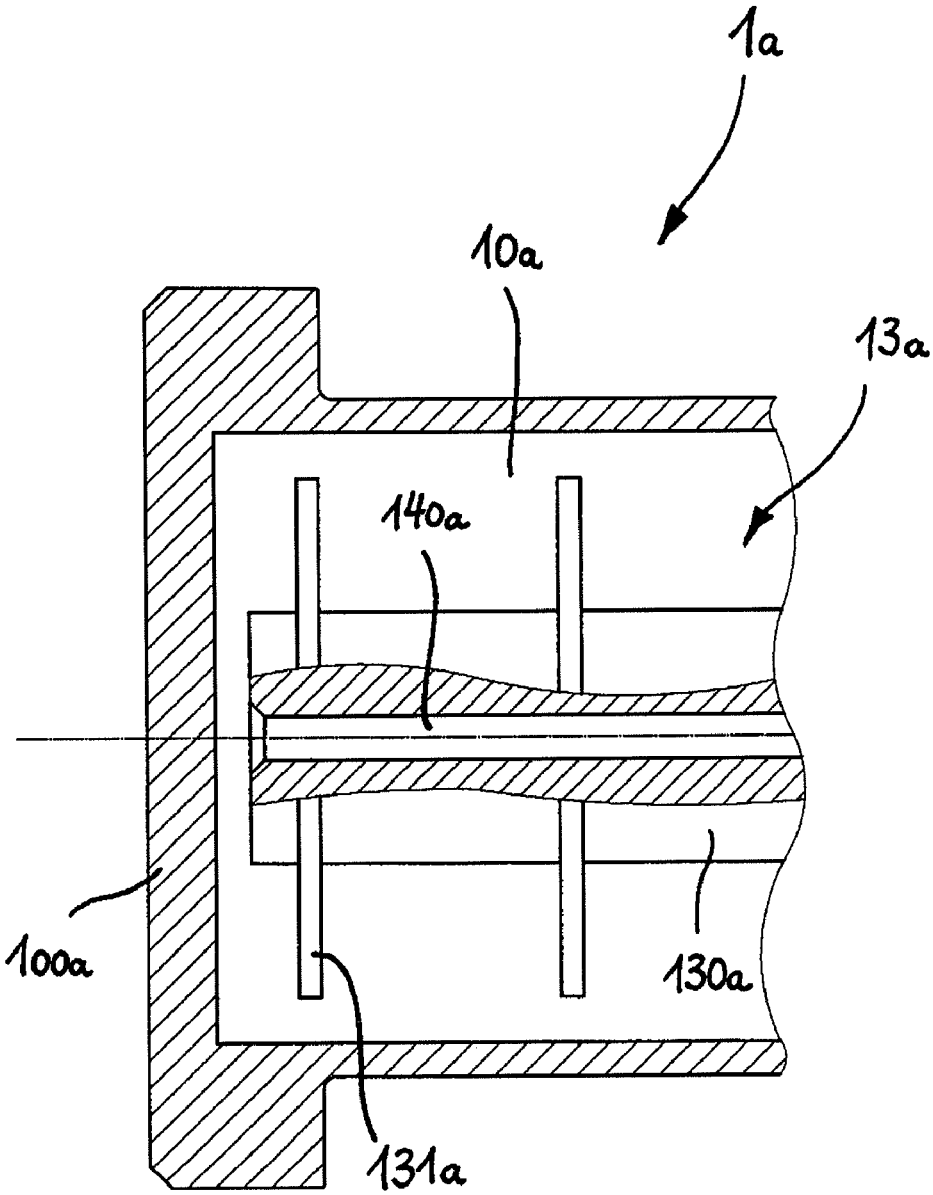
Figure 3:
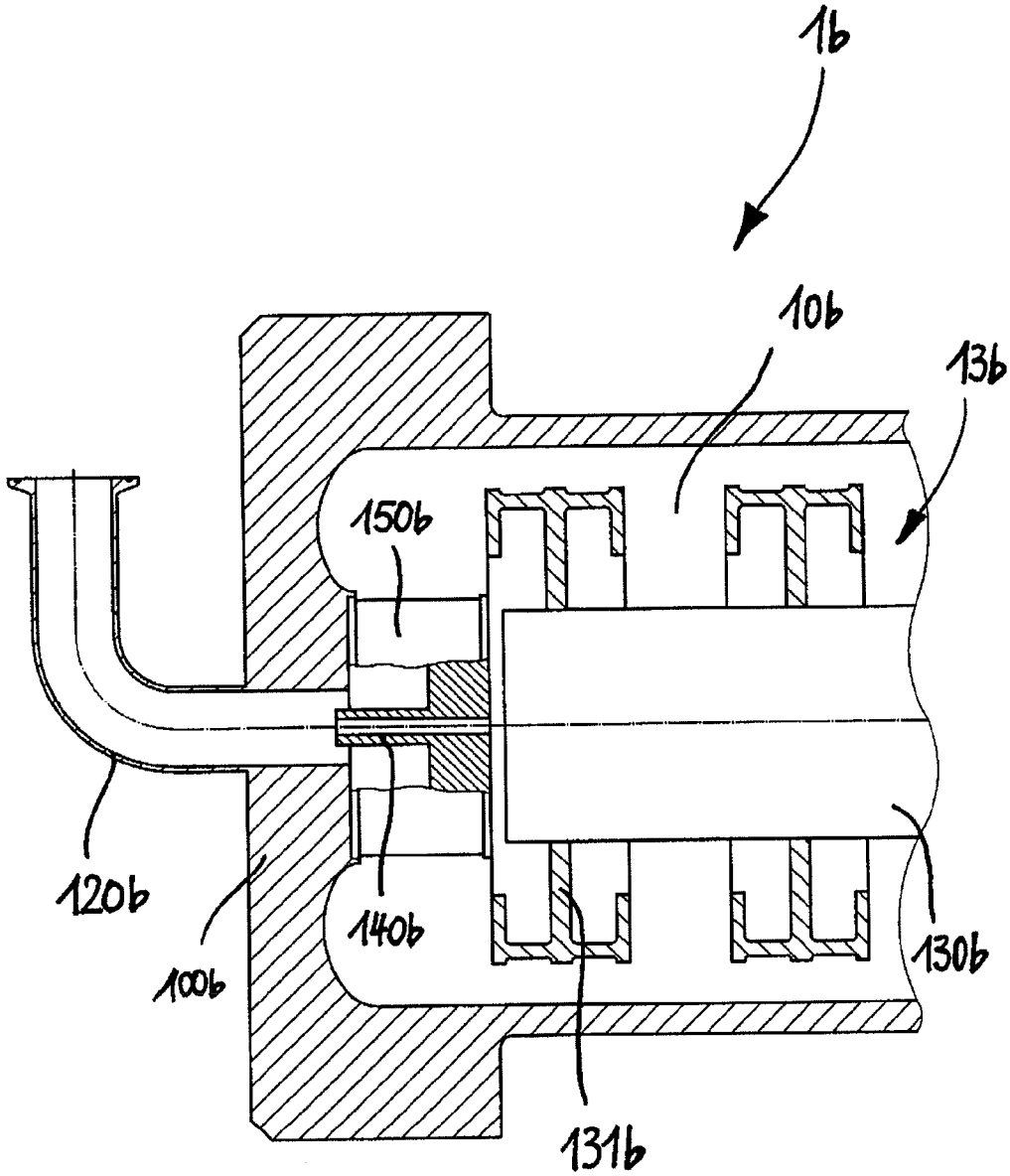
Figure 4:
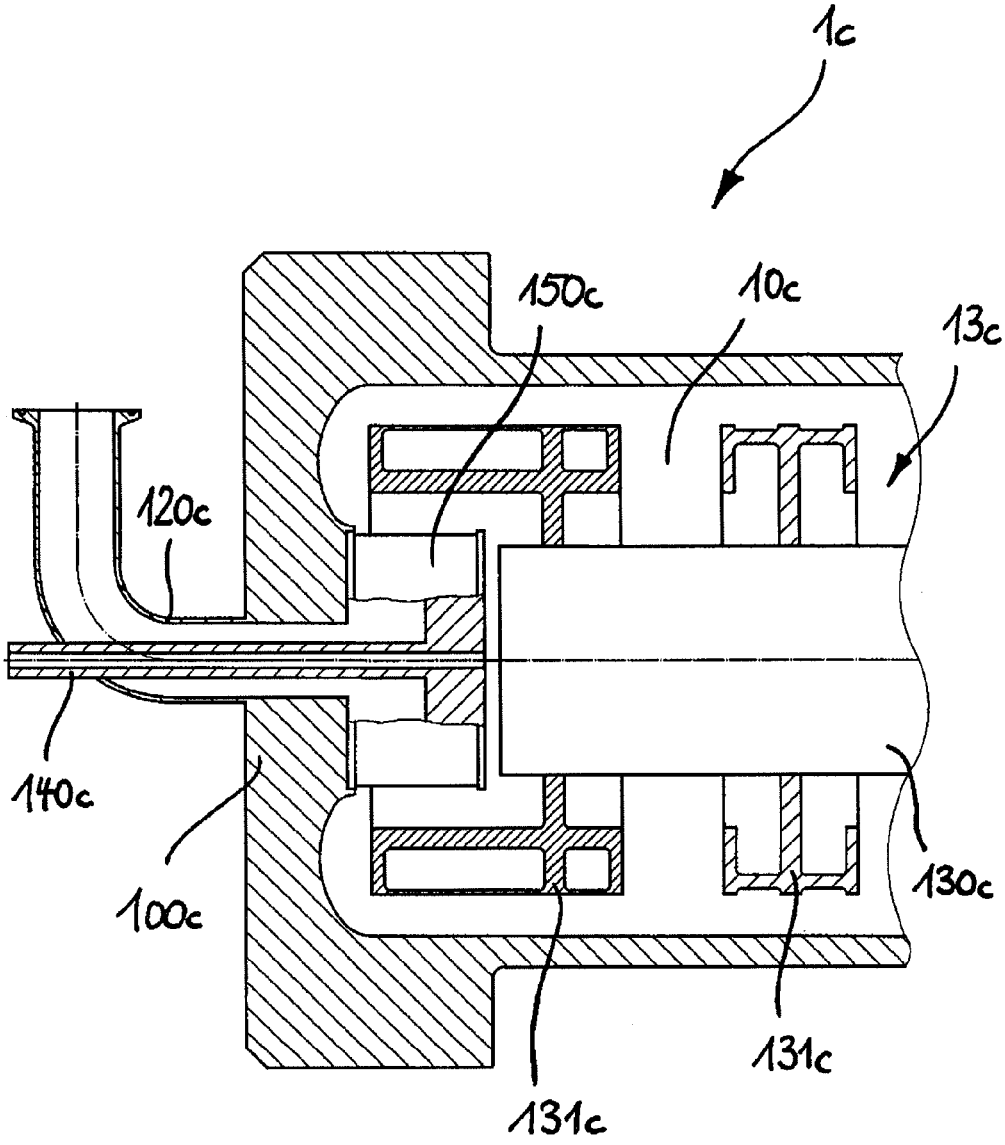
Figure 5:
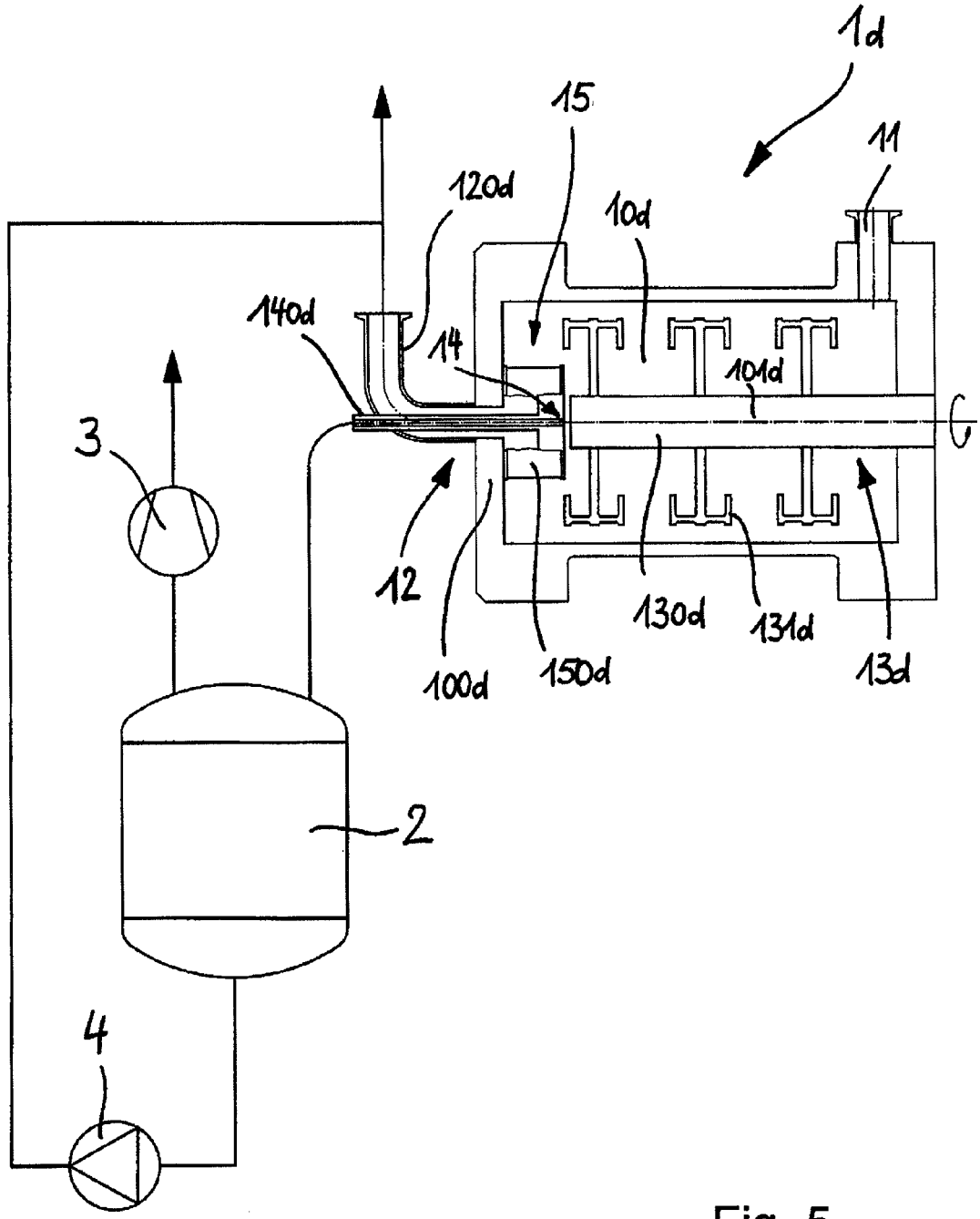

Further advantageous aspects of the agitator ball mill according to the invention can be gathered from the following description of exemplary embodiments, with the aid of the drawing, in which, schematically:

FIG. 1 shows a detail of a first exemplary embodiment of an agitator ball mill according to the invention, FIG. 2 shows a detail of a second exemplary embodiment of an agitator ball mill according to the invention, FIG. 3 shows a detail of a third exemplary embodiment of the agitator ball mill according to the invention, FIG. 4 shows a detail of a fourth exemplary embodiment of the agitator ball mill according to the invention, and FIG. 5 shows a fifth exemplary embodiment of the agitator ball mill according to the invention, with a vacuum vessel connected to the gas-outlet channel.

FIG. 1 illustrates a detail (outlet end) of a first exemplary embodiment of the agitator ball mill 1 according to the invention, in the case of which a gas-outlet channel 140 is led out through the outlet-end terminating wall 100 of the grinding chamber 10. The separate product outlet or product-outlet channel has not been illustrated for this exemplary embodiment. Agitating means 131 designed in the form of discs are arranged on the shaft 130 of the agitator 13.

FIG. 2 shows a detail (outlet end) of a second exemplary embodiment of the agitator ball mill 1*a* according to the invention, with a gas-outlet channel 140*a* running axially through the shaft 130*a* of the agitator 13*a*. In the case of this exemplary embodiment, the gas-outlet channel 140*a*, rather than being led outwards through the outlet-end terminating wall 100*a* of the grinding chamber 10*a*, is led outwards in the shaft 130*a* of the agitator. It is also the case with this exemplary embodiment that the agitating means 131*a* in a manner similar to the exemplary embodiment according to FIG. 1 are designed in the form of discs.

FIG. 3 shows a detail (outlet end) of a third exemplary embodiment of the agitator ball mill 1*b* according to the invention, with the grinding chamber 10*b* and with the shaft 130*b* of the agitator 13*b*, the shaft having agitating means 131*b* in the form of paddle-wheel-like accelerators arranged on it. The gas-outlet channel 140*b* runs through the centre of the interior of a screen cartridge 150*b*, but, rather than being led out of the grinding chamber 10*b* as a separate gas-outlet channel 140*b*, opens out into the product-outlet channel 120*b* in the region of the exit-end terminating wall 100*b*. This makes it possible to achieve a kind of Venturi effect, because the gaseous components, e.g. gas bubbles, are entrained by the solids suspension pumped through the product-outlet channel 120*b*.

FIG. 4 shows a detail (outlet end) of a fourth exemplary embodiment of the agitator ball mill 1*c* according to the invention, in the case of which, in addition to the paddle-wheel-like agitating means 131*c* (accelerators), it is also possible to see an additional agitating means 131*c* in the region of the end of the shaft 130*c* of the agitator 13*c*. Moreover, in the case of this exemplary embodiment, the gas-outlet channel 140*c* is led out of the grinding chamber 10*c* separately through the screen cartridge 150*c* and through the outlet-end terminating wall 100*c*, that is to say—in contrast to the exemplary embodiment according to FIG. 3—it does not open out into the product-outlet channel 120*c*.

FIG. 5 shows a schematic illustration of a fifth exemplary embodiment of the agitator ball mill 1*d* according to the invention, with a vacuum vessel 2 which is connected to the gas-outlet channel 140*d* of the agitator ball mill 1*d*. The fifth exemplary embodiment of the agitator ball mill 1*d* according to the invention, again, comprises a cylindrical grinding chamber 10*d* and an inlet 11, which is arranged at one end of the grinding chamber 10*d* and is intended for the material which is to be ground or dispersed e.g. a solids suspension. The material which is to be ground or dispersed can be fed to the grinding chamber 10*d* through the inlet 11. The grinding chamber 10*d* contains, during operation, the—typically spherical—grinding bodies (not illustrated), which consist, for example, of a ceramic material or of some other highly abrasion-resistant material. Also arranged in the grinding chamber 10*d* is the agitator 13*d* which can be rotated about the chamber axis, as axis of rotation 101*d*, and has agitating means 131*d* fixed on its shaft 130*d*.

Furthermore, the exemplary embodiment of the agitator ball mill 1*d* according to FIG. 5 has a product outlet 12, which is arranged at the other end (outlet end) of the grinding chamber 10*d* and is intended for the ground or dispersed material. The product outlet 12 comprises a product outlet channel 120*d* which extends through the outlet-end terminating wall 100*d* of the grinding chamber 10*d* and in this case, by way of example, is in the form of a curved piece of tube. FIG. 5 also shows a gas outlet 14 in the form of a gas-outlet channel 140*d*, which is arranged centrally at the outlet end of the grinding chamber 10*d* and in this case, by way of example, is designed in the form of a separate piece of tube which is led out of the grinding chamber 10*d* separately from the piece of tube in the form of the product-outlet channel 120*d*.

It is also possible to see in FIG. 5, in the region of the outlet end of the grinding chamber 10*d*, a separating means 15 in the form of a cylindrical screen cartridge 150*d* with a slotted screen (not illustrated), through which the ground or dispersed material can pass only essentially radially (inwards from the outside), so that it can then pass into the product-outlet channel 120*d*. It is basically also possible, however, for the ground or dispersed material and the grinding bodies to be separated in some other way, e.g. with the aid of rotating separating gaps or other suitable methods.

In the exemplary embodiment of the agitator ball mill 1*d* which is shown in FIG. 5, the agitating means 131*d* are designed, once again, in the form of paddle-wheel-like accelerators, in order to advance the grinding bodies, and the material which is to be ground or dispersed, radially in relation to the agitating shaft 130*d*. The rotation of the paddle-wheel-like agitating means 131*d* (accelerators) causes the grinding bodies to be subjected to a centrifugal force which advances the grinding bodies radially outwards.

As already mentioned in the introduction, the occurrence of gas bubbles in the material may give rise to the problems mentioned in the introduction (crust formation and the grinding bodies, and/or the material which is to be ground or dispersed, sticking together, reduction in the grinding capacity, possible blockage of the agitator ball mill, even more pronounced foaming, screen blockage, increase in the pressure in the grinding chamber, possible interruption to operation). Since the density of the solids suspension is greater than the density of any gaseous components, e.g. gas bubbles, the gas bubbles collect in the central region of the grinding chamber 10*d*. These gas bubbles can then be vented (led out) in the outward direction through the gas-outlet channel 140*d*, which is likewise arranged centrally (that is to say in the region of the centre) at the outlet end, so that foaming can be either avoided or, at any rate, vastly reduced.

The exit of the gas-outlet channel 140*d*, which is led through the outlet-end terminating wall of the grinding chamber 10*d* is connected here to the vacuum vessel 2 which has already been mentioned above and, for its part, is connected to a vacuum pump 3. In order for it not to be possible for any grinding bodies to flow out of the grinding chamber 10*d* as well, a screen (not illustrated) may be arranged at the entrance to the gas-outlet channel 140*d*. The vacuum pump 3 generates negative pressure in the vacuum vessel 2, as a result of which the gaseous components are vented (led out) of the grinding chamber 10*d* through the gas-outlet channel 140*d*, which runs in the axial direction through the centre of the interior of the screen cartridge 150*d*. If small quantities of the solids suspension are also extracted by suction from the grinding chamber by negative pressure, they can be separated off in the vacuum vessel 2 and then fed, with the aid of the delivery pump 4, to the ground or dispersed material which can be either led out or returned (led back) again, possibly via the inlet 11, into the grinding chamber 10*d* (or to a mixing vessel).

The invention has been described with reference to the above exemplary embodiments of the agitator ball mill. However, the invention should not be understood as being limited to these exemplary embodiments. Rather, numerous modifications to, and variants of, such an agitator ball mill are conceivable without departing from the technical teaching of the invention. It should be mentioned, merely by way of example, that it is also basically possible for the gas outlet to be designed as an outlet opening, rather than it necessarily having to have a channel, even if the exemplary embodiments described all have such a gas-outlet channel. The scope is thus defined by the following Claims.

The invention claimed is:

1. Agitator ball mill for finely grinding or dispersing a material, having a cylindrical or conical grinding chamber for accommodating grinding bodies and for accommodating the material which is to be ground or dispersed, further having an inlet for the material which is to be ground or dispersed, the inlet being arranged at one end of the grinding chamber, further having an agitator, which extends in the axial direction into the grinding chamber and has agitating means by way of which the grinding bodies and the material which is to be ground or dispersed are moved in the grinding chamber, and having a product-outlet channel for the ground or dispersed material, the product-outlet channel being axially arranged at the other end of the grinding chamber, with a separating means permeable to the ground or dispersed material, but not to the grinding bodies, being arranged upstream of the product-outlet channel and wherein a separate axially extending gas-outlet channel is provided which extends through the separating means and through which gaseous components, but not grinding bodies, can be discharged out of the grinding chamber.

2. Agitator ball mill according to claim 1, wherein the axially extending gas-outlet channel extends through a terminating wall which is arranged at the outlet end and bounds the cylindrical or conical grinding chamber.

3. Agitator ball mill according to claim 1, wherein the product-outlet channel and the gas-outlet channel are designed as outlet channels which are separate from one another.

4. Agitator ball mill according to claim 1, wherein an exit of the gas-outlet channel opens out into the product-outlet channel upstream of an exit of the product-outlet channel.

5. Agitator ball mill according to claim 1, wherein the separating means is arranged such that the ground or dispersed material can pass only essentially radially through the separating means and then into the product-outlet channel.

6. Agitator ball mill according to claim 5, wherein the separating means is designed as a cylindrical screen cartridge and in which the gas-outlet channel runs in the axial direction through the center of the interior of the screen cartridge.

7. Agitator ball mill according to claim 1, wherein at an entrance of the gas-outlet channel a screen is arranged, which is designed such that it restrains at least the grinding bodies in the grinding chamber.

8. Agitator ball mill according to claim 1, in which an exit of the gas-outlet channel is connected to a vacuum vessel and/or a vacuum pump.

9. Agitator ball mill according to claim 1, in which the agitator has a shaft, which has paddle wheels, discs or pins fixed thereon as agitating means.

* * * * *